United States Patent [19]

Robinson et al.

[11] 4,087,991

[45] May 9, 1978

[54] FASHIONED GARMENT INCLUDING BODY PANELS CONTAINING WALES RUNNING HORIZONTALLY AND INCLINED TO A FINISHED EDGE

[75] Inventors: Frank Robinson, Breaston; Keith Harry Girt, Menstone, Nr. Ilkley; Nigel Stephen Whatmough, Breaston, all of England

[73] Assignee: Courtaulds Limited, London, England

[21] Appl. No.: 713,424

[22] Filed: Aug. 11, 1976

[51] Int. Cl.[2] ..... D04B 7/10; D04B 7/22; D04B 7/30; A41D 1/04

[52] U.S. Cl. ..... 66/189; 66/176; 2/90; 66/172 R

[58] Field of Search ..... 66/175, 176, 177, 169, 66/170, 171, 189, 172 R

[56] References Cited

U.S. PATENT DOCUMENTS

| | | | |
|---|---|---|---|
| 2,042,582 | 6/1936 | Botts | 66/172 R |
| 2,734,360 | 2/1956 | Zesch | 66/189 X |
| 3,057,178 | 10/1962 | Konklin | 66/176 |
| 3,602,914 | 9/1971 | Castello | 66/172 R X |
| 3,812,692 | 5/1974 | Arndt | 66/172 R |
| 3,956,909 | 5/1976 | Negri | 66/177 |
| 3,990,271 | 11/1976 | Jeffcoat | 66/176 |

FOREIGN PATENT DOCUMENTS

| | | | |
|---|---|---|---|
| 348,499 | 10/1960 | Switzerland | 66/189 |
| 1,407,212 | 9/1975 | United Kingdom | 66/176 |

OTHER PUBLICATIONS

Dubied Knitting Manual, Neuchatel Switzerland, 1967 p. 57–58.

*Primary Examiner*—Mervin Stein
*Assistant Examiner*—Andrew M. Falik
*Attorney, Agent, or Firm*—Davis, Hoxie, Faithfull & Hapgood

[57] ABSTRACT

A method of knitting a body panel for a garment, for example a jacket, in which the panel is provided with a non-run set-up along at least one edge to serve as an edging for the panel. The method involves knitting an edge portion for the panel comprising a non-run set-up, knitting on from the edge portion on some only of the needles holding loops of the edge portion while maintaining inactive further needles holding loops of the edge portion, and introducing these inactive needles holding loops of the edge portion into knitting action subsequently during the knitting process, thereby shaping the panel. The edge portion may consist exclusively of the non-run set-up or it may have a non-run set-up followed by a further strip of fabric. This further strip of fabric may be distinguished from the fabric of the main part of the body panel by color and/or stitch structure. Methods of joining together two or more of such body panels on a knitting machine are described.

9 Claims, 5 Drawing Figures

FASHIONED GARMENT INCLUDING BODY PANELS CONTAINING WALES RUNNING HORIZONTALLY AND INCLINED TO A FINISHED EDGE

The present invention relates to the knitting of shaped body panels for garments and is concerned with a body panel which is provided with a non-run set up along at least one edge to serve as an edging for the panel. The labour involved in attaching edging to the panel is thereby avoided and the procedure of making up of the garment is rendered more economical.

According to the invention, a method of knitting a body panel for a garment comprises knitting an edge portion for the panel comprising a non-run set up, knitting on from the edge portion on some only of the needles holding loops of the edge portion whilst maintaining inactive further needles holding loops of the edge portion, and introducing said inactive needles holding loops of the edge portion into knitting action subsequently during the knitting process, thereby shaping the panel. The invention also includes a knitted garment incorporating a panel as just described.

The panel may, in addition, be shaped at a position or positions remote from said edge portion by taking needles out of action during the knitting process and either casting off the loops on those needles or holding the loops on the needles taken out of action. Such shaping may provide an edge of the panel inclined to the direction of the courses in the panel to serve as a line along which the panel is joined to a sleeve of a garment.

The said edge portion may consist exclusively of a non-run set-up or it may comprise a non-run set-up followed by a further strip of fabric. Said further strip of fabric may be distinguished from the fabric of the main part of the body panel by colour or stitch structure or both.

Advantageously, knitting of the non-run set-up of said edge portion is begun on bare needles and on completion of the panel, the needles may be operated to cast off their loops and free the panel from the needles. Alternatively, knitting may be continued to produce a further panel of the garment integral with the first-mentioned body panel. For example, needles holding loops of the panel may be taken out of action progressively along a sleeve-body join line in the panel and these needles may be brought progressively back into action to knit a sleeve panel integral with the body panel, at least above the arm pit region. A similar progressive holding up and reintroduction of the needles may be employed to join the sleeve panel thus knitted to a further body panel, or part of a body panel, of the garment.

Two body panels may be formed at the same time on the same knitting machine, a single edge portion comprising a non-run set-up being first knitted to extend along an edge of each body panel and between the two panels, for example in the neck region of a garment, and thereafter each panel being knitted on from the associated section of the edge portion in the manner described above. A separate sleeve portion may be knitted on from each of the two body panels followed by a further body panel, if desired, also in the manner described above.

The invention includes a garment body panel shaped so that at least one edge of the panel has a part inclined to the courses of the panel, said one edge having an integrally knit edge portion comprising a non-run set-up serving as an edging for the panel.

The invention will be further described, by way of example, with reference to the accompanying drawings in which.

Figure 1:
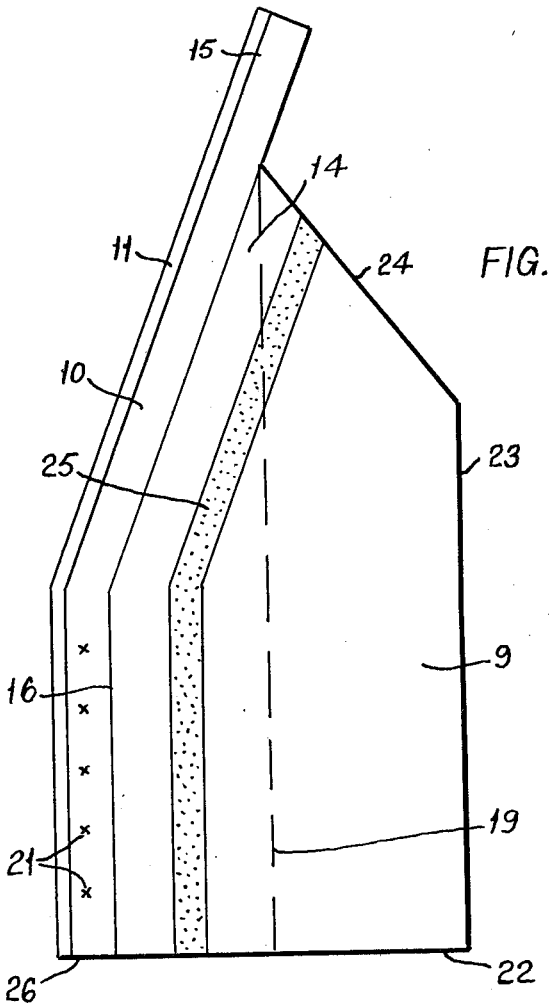
FIG. 1 shows a garment body panel according to the invention.

In knitting the garment panels shown in the drawings, there is used a knitting machine having two opposed needle beds, individually operable needles and means for taking down or pushing down the fabric which allows knitting to be carried out on some needles whilst other adjacent needles are inactive but hold loops of the knitted fabric, preferably means such as described in British Pat. Specification No. 1,288,043. A commercially available knitting machine which can be used for knitting the garment panels shown, when adapted by fitting to it a mechanism as described in British patent specification No. 1,288,043, is the machine manufactured by Edouard Dubied & Cie. of Neuchatel, Switzerland and designated by them the "JDR".

Figure 3A:
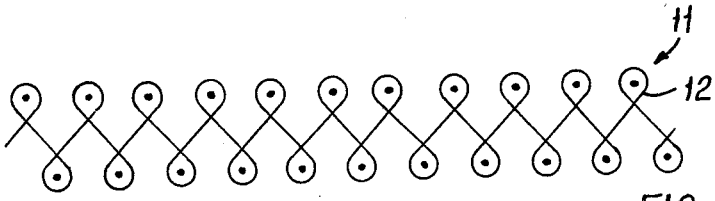
FIGS. 3*a*–3*c* show diagrammatically some stages in knitting a garment body panel according to the invention.
Figure 3B:
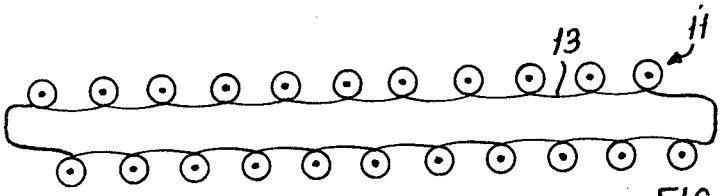

The knitted panel 9 shown in FIG. 1 is a front body panel for a jacket. It is knitted commencing with an edge portion 10 which is started by knitting a non-run set-up constituted by a welt 11, in this case a tubular welt having a first course 12 (FIG. 3*a*) of rib knitting formed on needles of both of the opposed needle beds of the machine, to serve as an edging for the panel 9. The tubular welt 11 is continued by knitting one or more courses 13 (preferably from two to six courses) in tubular form on both beds of needles (FIG. 3*b*). Instead of a tubular welt, a roll welt may be knitted to constitute a non-run set-up.

The edge portion 10 is knitted so as to be longer than the adjacent part 14 of the panel 9, the portion 15 of the edge portion which extends beyond the main body of the panel 9 serving as an edging around the neck part of the garment in which the panel is eventually incorporated.

Figure 3C:
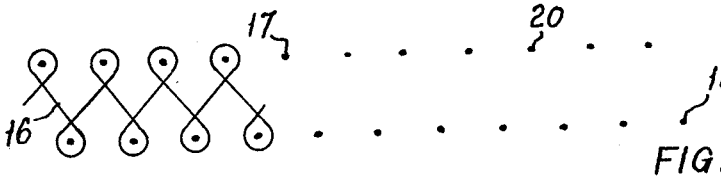

When the welt 11 has been completed, knitting of the edge portion 10 is continued in a rub structure, for example full milano, on both beds of the knitting machine using all the needles holding loops of the welt. On completion of the edge portion 10, knitting is continued in a different stitch structure, for example half milano, to knit the main body of the panel 9 starting with a course 16 (FIG. 3*c*) which is not quite half the length of the courses of the edge portion 10. In subsequent courses of the panel, inactive needles which are still holding loops of the edge portion 10 are brought back into knitting action progressively in the direction from the needle 17 to the needle 18 in FIG. 3*c*. The courses of the panel 9 thus increases in length successively and the panel 9 is thereby shaped.

The edge portion 10 need not be distinguished from the body of the panel by stitch structure or by colour of yarn. It may, however, be distinguished from the body of the panel 9 solely by the colour of the yarn used, the stitch structure in the body of the panel 9 and in the edge portion being the same. Alternatively, both colour of yarn used and stitch structure may be different in the edge portion and the main body of the panel. The edge portion 10 may consist solely of the welt 11 in which case the part course 16 is knitted immediately after the welt.

When the course 19, the longest course of the main body of the panel 9, has been knitted, the courses of the panel are successively decreased in length by taking needles out of action progressively begining at the needle 18. The inactive needles still hold their loops and when the panel 9 is completed, all the needles holding loops, that is needles holding loops in the edge 23 of the panel 9 as well as needles holding loops along the shaping line 24 are operated to cast off their loops and free the panel 9 from the needles. The resulting panel 9 with the integral edge portion 10, including the welt 11 serving as a trimming or stolling, is ready for incorporation in a garment. In the making-up procedure, the line 24 will be joined to a similar line in a sleeve panel for the garment.

The knitting machine may be programmed to mark the fabric, for example by knitting tuck stitches at points 21 in the edge portion 10 where button holes are to be formed, or buttons are to be attached.

In addition to having an extension portion 15 to serve as an edging around the neck part of the garment, the panel 9 may have an extension (not shown) of the edge portion 10 at the lower (waist) end of the panel which can be folded to lie along the lower edge 22 of the panel.

The lower corner 26 of the panel 9 may be shaped in a similar way to the upper part of the non-run set-up, needles being taken out of action after completion of the edge portion 10 and reintroduced in subsequent courses to produce a panel suitable for a waistcoat front.

By supplying differently coloured yarn to the needles for a number of courses, stripes, for example stripe 25, may be formed in the panel 9. Since the edge 10 of the panel 9 is intended to be the edge of the front opening of a jacket and the edge 23 is intended to be the line of the body side seam extending up to the arm pit, the stripe 25 is, in its lower region, vertical. The courses of the panel run up-and-down when the panel is worn as part of a garment, whereas the wales are then horizontal.

The panel 9 is made up into a jacket by seaming it to a sleeve panel along the line 24 and to a rear panel (not shown) for the garment along the edge 23, the sleeve panel being also seamed to the rear panel. The rear panel is also seamed to another sleeve panel and to a further front panel which is a mirror image of the panel 9.

In order to reduce the number of seams required in the making up procedure, a panel according to the invention may be joined integrally in the knitting process with other panels of the garment, for example a sleeve panel and, if desired, also with a rear garment panel.

Figure 2:
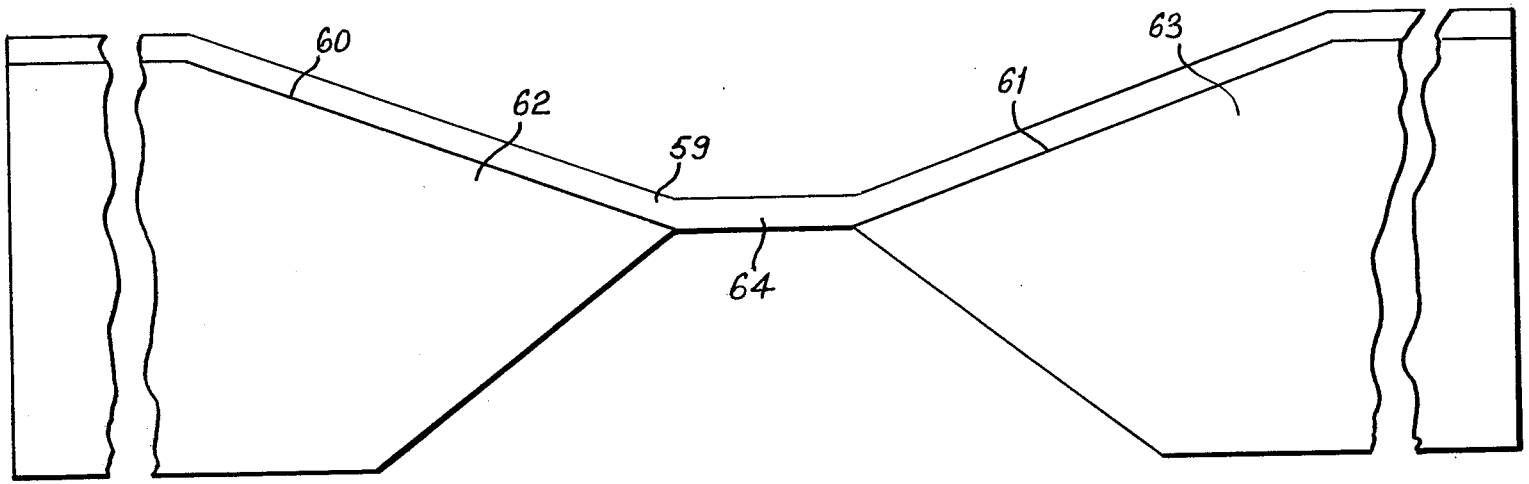
FIG. 2 shows two garment body panels according to the invention integrally joined by a unitary piece of welt fabric.

FIG. 2 illustrates another method of knitting panels according to the invention in which an edge portion 59, including or consisting solely of a welt, is first knitted with a length equal to the sum of the lengths of the edges 60 and 61 of two front body panels 62 and 63 and a further length 64 comprising a piece of the edge portion intended to extend around the periphery of a rear part of the neck opening of the garment. Knitting of the two panels 62 and 63 is continued from the edge portion 59 in a similar manner to the knitting of the panel 9 of FIG. 1, two mirror image panels thus being formed simultaneously.

As in the case of the panel described above with reference to FIG. 1, other garment panels may be integrally joined in the knitting process to the edge portion 59 and to the panels 62 and 63.

What is claimed is:

1. A method of knitting a body panel for a garment, said method comprising (a) knitting an edge portion for said panel, said edge portion comprising at least a non-run set-up, (b) knitting on from said edge portion on some only of needles holding loops of the edge portion, whilst maintaining inactive further needles holding loops of said edge portion, and (c) introducing said inactive needles holding loops of the edge portion into knitting action subsequently during the knitting process, thereby shaping said panel, with wales inclined to said edge portion.

2. A method as claimed in claim 1 further comprising the step of knitting said edge portion so that it is long enough to extend from the panel.

3. A method as claimed in claim 1 further comprising the step of knitting a further strip of knitted fabric integral with said non-run set-up, said set-up and said further strip of fabric together constituting said edge portion.

4. A method as claimed in claim 1 wherein knitting of said edge portion is begun on bare needles and on completion of the panel the needles are operated to cast off the panel from the needles.

5. A method of knitting a pair of body panels for a garment said method comprising the steps of (a) knitting a single edge portion for said panels comprising at least a non-run set up, (b) knitting on from said edge portion to form two body panels at spaced locations along said edge portion and leaving a part of said edge portion between such panels to constitute a neck trim for the garment.

6. A method for knitting a body panel for a garment, said method comprising (a) knitting an edge portion for said panel, said edge portion comprising at least a non-run set-up, (b) knitting on from said edge portion on some only of needles holding loops of the edge portions, whilst maintaining inactive further needles holding loops of said edge portion, (c) introducing said inactive needles holding loops of the edge portion into knitting action subsequently during the knitting process, thereby shaping said panel; and (d) further shaping said panel along an edge separate from said edge portion by taking out of action during the knitting process needles holding loops of the panel.

7. A garment body panel knitted to shape, said body panel having (a) an edge including a part inclined to courses of said panel, (b) an edge portion knitted integrally with said panel, said edge portion comprising (c) at least a non-run set-up and extending along said edge to constitute an edging for said panel, (d) the wales of said panel extending horizontally from the non-run set-up edge portion of said panel.

8. A garment body panel as claimed in claim 9 wherein said edge portion is longer than said edge of the panel and extends from the panel.

9. A pair of garment body panels knitted to shape, each of said panels having (a) an edge including a part inclined to courses of said panel, the pair of panels including
(b) an edge portion knitted integrally with each panel and comprising
(c) at least a non-run set-up,
(d) said edge portion extending along said edge of each of said panels and between said panels which are spaced apart along the edge portion.
(e) the wales of said panels extending horizontally from the non-run set-up edge portion of each panel.

* * * * *